United States Patent [19]

Lokken et al.

[11] Patent Number: 4,667,491

[45] Date of Patent: May 26, 1987

[54] PORTABLE TRAVEL SAFE

[76] Inventors: Donald Lokken, Star, Rte. 2, Box 352A; Lawrence Berg, R.R. 1, Box 101B, Lynda Berg, Star Rte. 2, Box 352A, all of Hibbing, Minn. 55746

[21] Appl. No.: 820,077

[22] Filed: Jan. 21, 1986

[51] Int. Cl.[4] ..... E05B 65/52

[52] U.S. Cl. ..... 70/63; 70/18

[58] Field of Search ..... 70/63, 54, 56, 49, 18; 109/45, 52, 59 R, 59 T; 232/15

[56] References Cited

U.S. PATENT DOCUMENTS

| | | | |
|---|---|---|---|
| 1,955,809 | 4/1934 | Hobbs | 109/5 |
| 3,808,847 | 5/1974 | Vesaly | 70/18 |
| 3,851,506 | 12/1974 | Simon | 70/271 |
| 4,258,632 | 3/1981 | LaPointe | 109/59 |
| 4,457,240 | 7/1984 | Hungerford | 109/45 |
| 4,462,317 | 7/1984 | Franko et al. | 109/45 |
| 4,474,116 | 10/1984 | Castenada, Jr. et al. | 109/53 |

FOREIGN PATENT DOCUMENTS

| | | | |
|---|---|---|---|
| 2037257 | 7/1980 | United Kingdom | 70/63 |

*Primary Examiner*—Robert L. Wolfe

*Attorney, Agent, or Firm*—Schroeder & Siegfried

[57] ABSTRACT

A portable lock box is disclosed that is formed from an outer four-sided hollow tubular elongated structure having a rectangular cross-section with an elongated slot form transverse to the housing and an inner housing having closed end U-shaped members in overlapping leg configuration secured to each other in which one of the legs has a cooperating elongated slot to admit the latch member of a cam lock that is secured to one of the closed ends of the U-shaped members. A tray is provided to secure the valuables within the inner housing and a looped steel cable extends through a pair of slots formed in the edge of one of the closed ends of the U-shaped members.

4 Claims, 8 Drawing Figures

PORTABLE TRAVEL SAFE

DESCRIPTION

Background of the Invention

This invention relates to a safe for securing valuables and more particularly to a portable lock box that may be secured to a fixed object.

It has long been known that portable lock boxes or safes are highly desirable if someone is carrying their valuables while on a trip or a vacation. There is a need for a strong box that may be used for an individual who is traveling but cannot carry with them a safe or lock box of the weight and size most often being used.

Description of the Prior Art

Most security type boxes generally are formed where an outer box has a single opening that is secured about an inner box that has a mating singular opening such as found in U.S. Pat. No. 4,462,317 entitled "Lock Boxes". For such a configuration as shown in the above patent, the lock mechanism is secured within the inner walls of the outer and inner box-like members. Through a lateral movement of the inner box within the outer box, the lock mechanism is secured.

Another style of portable safe keeping box is that shown in U.S. Pat. No. 4,258,632 entitled "Individual Safe Keeping Box" in which there is a closed end upon a tubular member and the open end is closed through a door 67. This particular mechanism does not have any provision for securing the safe to an immovable object such as a radiator pipe or other object that is immovable.

U.S. Pat. No. 4,474,116 entitled "Safe Box With Anchor Chain" discloses a means of securing an anchor chain by placing links of the chain over a pair of posts within the portable box.

U.S. Pat. No. 1,955,809 entitled "Safety Box" does disclose a form of box which slides into a tubular member and has a lock extension that engages a latch member. This latch member and extension appear to form the weak link in the safety box.

Brief Description of the Invention

On the other hand, the present invention makes use of a four-sided hollow tubular member that is slipped around a second tubular member formed of a pair of U-shaped members in which the legs are overlapped and a cam lock is secured to one of the closed ends of the U-shaped members to provide a convenient and tamper free mechanism that is secured by a cam lock extending through the outer and inner portable four-sided structure.

It is therefore a general object of this invention to provide an improved portable lock box;

It is still another object of this invention to provide a portable lock box that is formed from two hollow tubular elongated structures.

It is yet another object of this invention to provide a tray to be disposed within said pair of hollow tubular elongated structures.

It is yet another object of this invention to provide a looped steel cable extended through a pair of slots and adapted to be secured around a fixed object.

These and other objects and advantages of the invention will more fully appear from the following description, made in connection with the accompanying drawings, wherein like reference characters refer to the same or similar parts throughout the several views, and in which.

Detailed Description of the Invention

Figure 1:
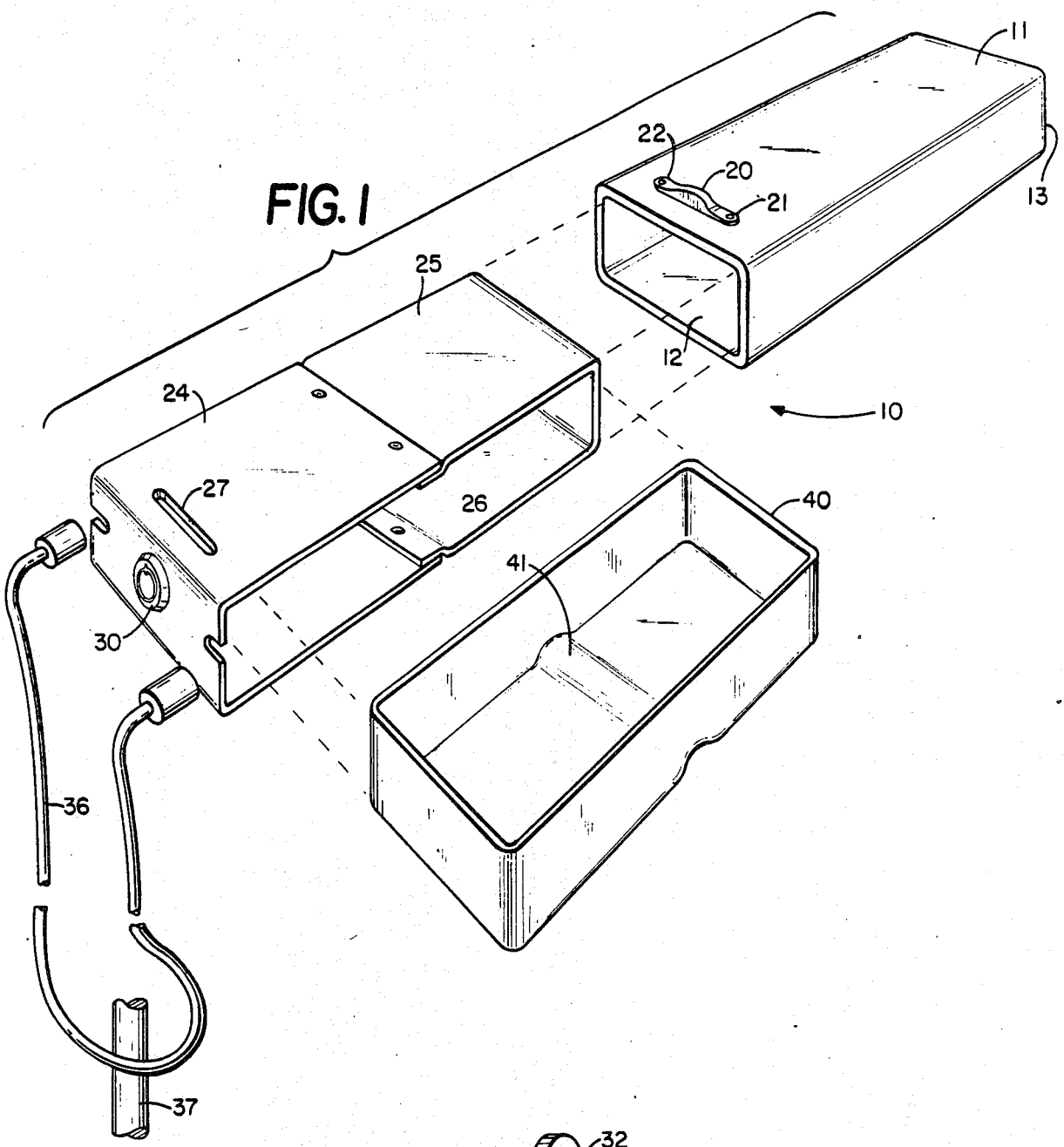
FIG. 1 is an exploded view of a portable lock box utilizing the invention.

Turning now to the Figures, there is disclosed a portable lock box 10 that is formed in multiple parts. An outer 4-sided hollow tubular elongated structure 11 is made in a rectangular cross-section and has a pair of open ends 12 and 13. On the upper side 14 of structure 11 will be found an elongated slot 15 that is disposed transverse to an axis defined by the longitudinal structure 11. The elongated slot 15 is disposed between a pair of rivet holes 16 and 17 formed in the outer casing of the housing. The material is 14 guage heat treated steel which is carburized hard at a hardness of 62–64 Rockwell "C".

Disposed over slot 15 is a latch cover 20 that is secured in place by a pair of steel rivets 21 and 22 that are secured to housing 11 prior to the heat treating process. The cover 20 has an opening formed therein that is disposed over slot 15 and thus protects any latch mechanism that may be extended through slot 15.

A second hollow tubular elongated structure 23 is formed from a pair of closed end U-shaped members 24 and 25 in which one leg of each overlaps the other and the two legs are secured in place by a plurality of rivets 26. The rivets and the U-shaped members are hardened after being assembled and a slot 27 is formed transversely across the upper side of U-shaped member 23 so that a cam lock 30 may be secured to end 23 by a suitable means such as a nut 31. Secured to the end of cam lock 30 is a latch member 32 that is secured in place by a nut 33.

Figure 6:
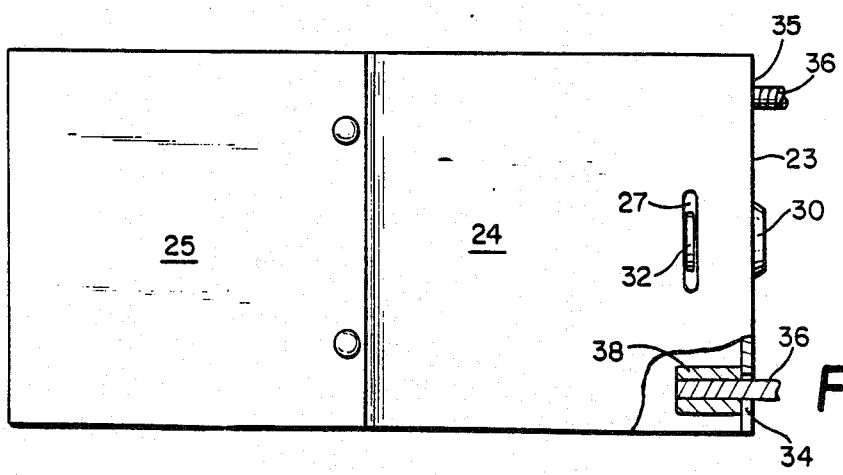
FIG. 6 is a top plan view of the inner housing.
Figure 7:
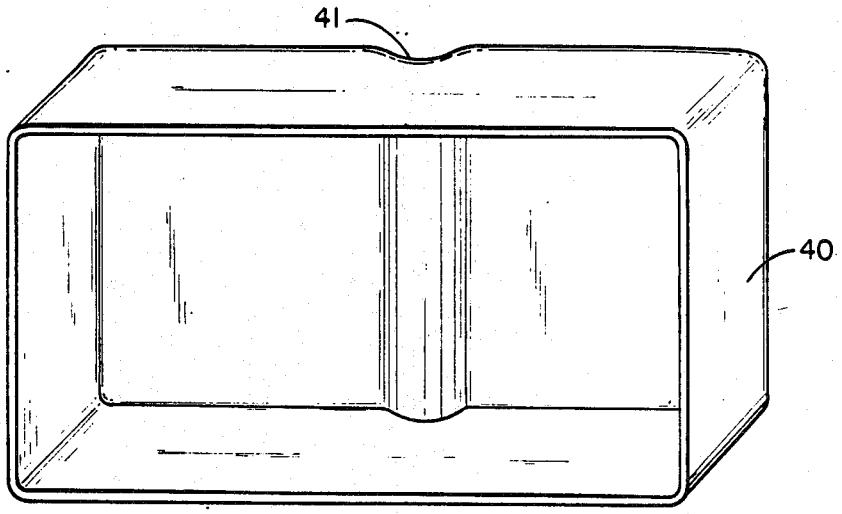
FIG. 7 is a perspective view of a tray that slides in the inner housing.

A pair of slots 34 and 35 are formed in end member 23 to accommodate a looped steel cable 36 that may be secured around an immovable object such as a pipe 37. A pair of metal stop sleeves 38 and 39 are secured about the end cable 36 and disposed behind the face of end member 23 within slots 34 and 35 to secure cable 36 in place. In FIG. 6, the corner of U-shaped section 24 is shown broken away to expose the end of cable 36.

To make it more desirable to put valuables within the travel safe, a tray 40 is provided that has a recessed bottom 41 that slides over rivets 26 and that portion of the housing where U-shaped pieces 25 and 24 are joined.

Figure 8:
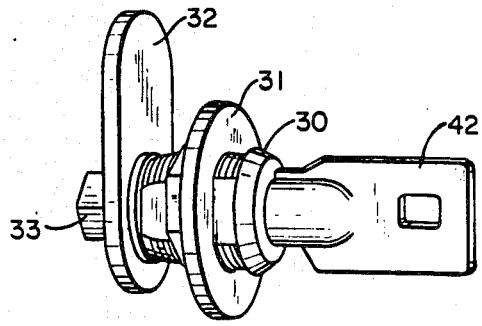
FIG. 8 is a perspective view of a cam lock used with the housing forming the portable lock box.
Figure 2:
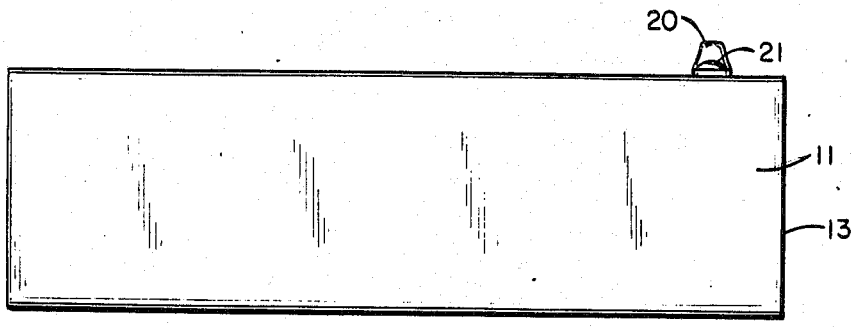
FIG. 2 is a side elevation of our portable lock box.
Figure 3:
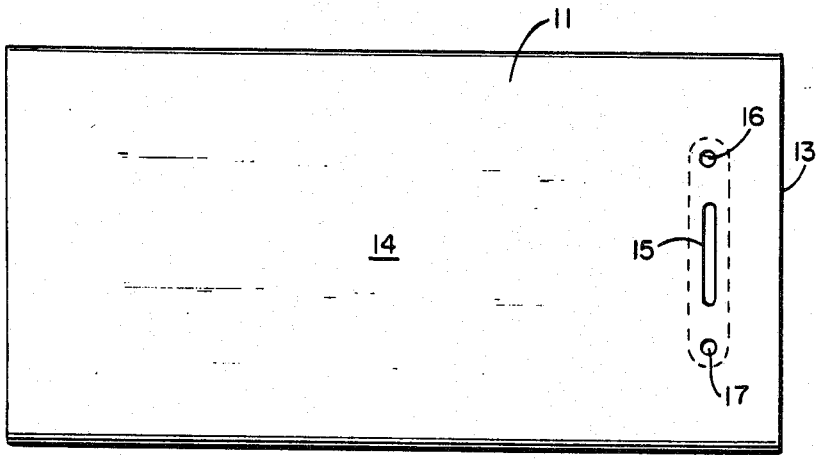
FIG. 3 is a top plan view of the portable lock box.
Figure 4:
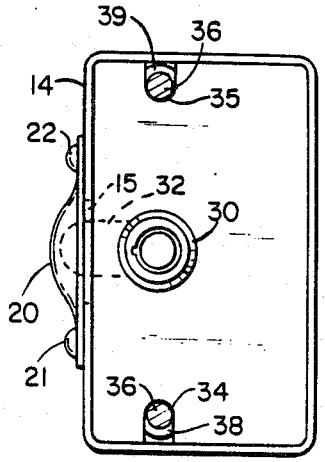
FIG. 4 is an end elevation of the portable lock box.
Figure 5:
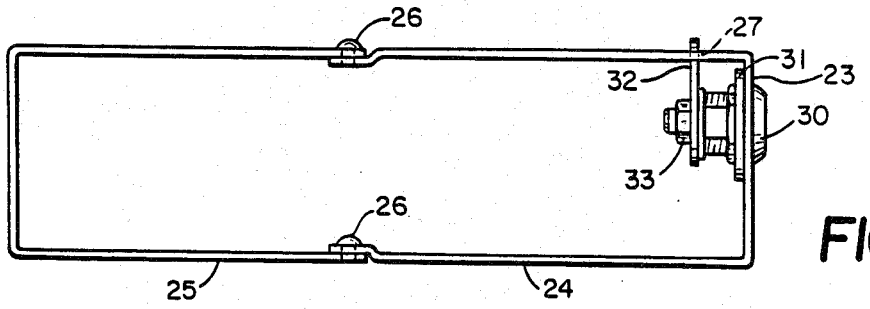
FIG. 5 is a side elevation of an inner housing structure.

Thus, it will be seen that a convenient means has been provided in which a person who is traveling may place their valuables, and slide them into the second 4-sided tubular elongated structure and the second 4-sided tubular structure may then be secured within the outer housing which is also a 4-sided hollow tubular elongated structure. Once a key 42 (FIG. 8) is inserted in the lock and the two mechanisms secured together by lock 30 and latch 32 prevents the removal of the contents of the box and with cable 36 wrapped around an immovable object such as a pipe, the valuables remain secured.

It will, of course, be understood that various changes may be made in the form, details, arrangement and proportions of the parts without departing from the scope of the invention which consists of the matter shown and described herein and set forth in the appended claims.

What is claimed is:

1. An improved portable lock box comprising:

(a) a four sided hollow tubular elongated structure, having a rectangular cross-section and a pair of open ends, one of said sides having a first elongated slot formed therein transverse to an axis defined by said elongated structure;

(b) a pair of closed end U-shaped members having overlapping leg configurations, with one leg having a second elongated slot cooperating with said first elongated slot and formed therein transverse to said axis defined by said elongated structure;

(c) a plurality of securing mechanisms securing said legs of said pair of U-shaped members to each other to form a second four sided tubular elongated structure having open sides and a hollow rectangular cross section of smaller dimensions than said first four sided structure;

(d) a tray disposed within said pair of U-shaped members for containing valuables; and (e) a cam lock secured in one of the closed ends of said U-shaped members having a latch member extending through and cooperating with, said first and second elongated slots to create a locking mechanism for locking said second four sided tubular elongated structure to said first four sided tubular structure when inserted to a proper depth within said first four sided tubular elongated structure.

2. The structure set forth in claim 1 including:

(f) a latch member cover secured to said four sided tubular elongated structure and disposed over said first elongated slot to permit said latch member to operate but not be exposed to external forces.

3. The structure set forth in claim 1 including:

(g) a pair of slots formed in the edge of one of said closed ends of said U-shaped members;

(h) a looped steel cable extending through said pair of slots and adapted to be secured around an immovable object; and (i) a metal stop sleeve secured about each end of said cable, and disposed inside said closed ends of said U-shaped members.

4. The structure set forth in claim 1 wherein said plurality of securing mechanisms are hardened steel rivets passing through both thicknesses of said pair of overlapping leg configurations.

* * * * *